United States Patent [19]

Burton et al.

[11] Patent Number: 4,598,376

[45] Date of Patent: Jul. 1, 1986

[54] METHOD AND APPARATUS FOR PRODUCING CUSTOM MANUFACTURED ITEMS

[75] Inventors: James O. Burton, Cleveland Heights; Timothy S. Adam, Garfield Heights; Frank W. Budziak, Cleveland; Michael W. Nekoloff, Parma, all of Ohio

[73] Assignee: Richman Brothers Company, Cleveland, Ohio

[21] Appl. No.: 604,982

[22] Filed: Apr. 27, 1984

[51] Int. Cl.[4] ..... G06F 15/46

[52] U.S. Cl. ..... 364/470; 33/17 A; 364/192; 364/475; 364/900

[58] Field of Search ..... 364/468, 470, 475, 148, 364/191-193, 200 MS File, 900 MS File; 33/17 R, 17 A, 11, 12

[56] References Cited

U.S. PATENT DOCUMENTS

| | | | |
|---|---|---|---|
| 2,624,943 | 1/1953 | Booth | 33/17 |
| 2,631,374 | 3/1953 | Purdy | 33/2 |
| 3,083,465 | 4/1963 | Totten | 33/12 |
| 3,339,182 | 8/1967 | Horwitz et al. | 364/900 |
| 3,391,392 | 7/1968 | Doyle | 364/900 |
| 3,596,068 | 7/1971 | Doyle | 364/475 |
| 3,683,504 | 8/1972 | Roth | 33/17 A |
| 3,753,293 | 8/1973 | Branda et al. | 33/174 D X |
| 3,761,675 | 9/1973 | Mason et al. | 219/121 LM |
| 3,816,924 | 6/1974 | Cutri | 33/17 R |
| 3,818,756 | 6/1974 | Barron et al. | 73/172 |
| 3,875,389 | 4/1975 | McFadden et al. | 364/475 |
| 3,887,903 | 6/1975 | Martell | 364/900 |
| 3,899,949 | 8/1975 | Bystron et al. | 33/12 |
| 3,909,947 | 10/1975 | Voth et al. | 33/17 R |
| 3,949,629 | 4/1976 | Johnson | 33/17 R X |
| 4,027,395 | 6/1977 | Vlahakis | 33/11 |
| 4,047,951 | 9/1977 | Cooper et al. | 33/17 R X |
| 4,136,452 | 1/1979 | McMillan | 33/17 R |
| 4,149,246 | 4/1979 | Goldman | 364/900 |
| 4,527,402 | 7/1985 | Swallow et al. | 364/470 X |

FOREIGN PATENT DOCUMENTS

| | | |
|---|---|---|
| 1463804 | 2/1977 | United Kingdom . |
| 1571290 | 7/1980 | United Kingdom . |

OTHER PUBLICATIONS

Department of Textile Technology, The Apparel Crisis in Sweden . . . Counter-Measure and Developments, Goteborg, Sweden.

*Primary Examiner*—Joseph Ruggiero
*Attorney, Agent, or Firm*—Watts, Hoffmann, Fisher & Heinke Co.

[57] ABSTRACT

Automated made-to-measure garment manufacturing method and apparatus. A subject's mesurements are taken with a hand held measuring device and transmitted to a computer. The computer checks to see if the customer's style preference and physique are compatible and if they are, an order is generated. The customer measurements are then transmitted to a remote location for manufacture. At this location a computer has a set of co-ordinates defined for the customer's style in one size. These co-ordinates are modified based upon the actual customer measurements to produce a modified set of co-ordinates which in turn define the garment pieces for that customer. A control tape for a laser cutter is generated and the garment pieces are cut and sewn together. During the post cutting fabrication process, routing sheets for the garment indicate precision assembly steps to insure a quality finished garment is produced. Finally, the custom tailored suit is sent back to the retail outlet and delivered to the subject.

21 Claims, 14 Drawing Figures

Fig. 2
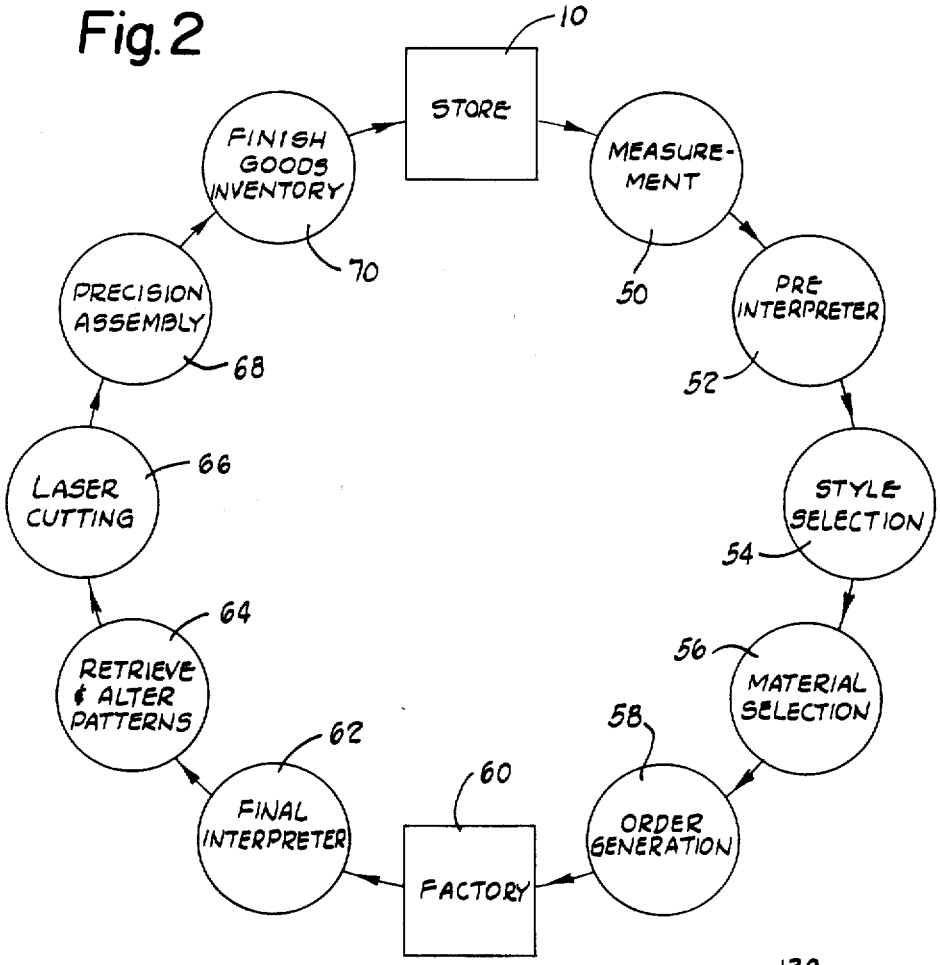
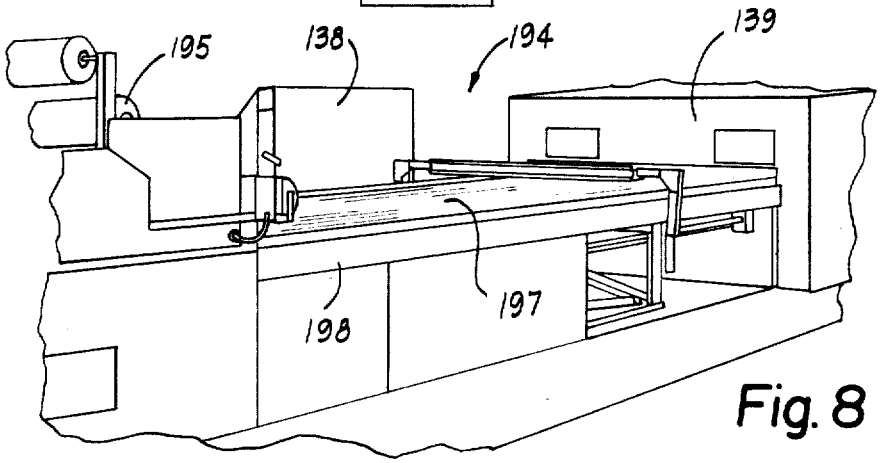
Fig. 8

METHOD AND APPARATUS FOR PRODUCING CUSTOM MANUFACTURED ITEMS

DESCRIPTION

1. Technical Field

The present invention relates to method and apparatus for producing custom manufactured items and has particular utility for producing individually tailored suits by cutting appropriately sized parts from a supply of fabric.

2. Background Art

The garment industry has been slow in taking advantage of advances in technology to modernize its manufacturing operations. The techniques utilized in fitting a suit, for example, vary in only minor aspects from the techniques used 50 years ago. A person familiar with the suit making business in 1900 would not be unfamiliar with the techniques and machinery for producing suits in the 1980's. The reluctance to change by the suit manufacturing industry has placed those manufacturers operating where labor costs are high at a distinct competitive disadvantage in relation to manufacturers who have less expensive sources of labor available.

Traditional steps in tailoring a suit to a customer's specification have been inefficient for a number of reasons. The most widely practiced suit tailoring technique is familiar to anyone who has purchased a suit at a clothing store. The customer enters the store, approaches the rack where his or her size is located and looks over the suits available in that size. If the customer finds an appropriate suit, either a clerk or a tailor determines what alterations are needed to make the suit fit. Once the needed alterations have been determined by the tailor and/or clerk, and approved by the customer, the tailor can begin the task of altering the suit.

This off-the-rack method of suit tailoring causes inefficiencies which add to the cost of the suit. One inefficiency is the requirement that a large number of suits be stocked by the retail men's clothing store. To increase the odds that each customer entering the clothing store will find an appropriate suit, a wide variety of styles, patterns, and sizes must be on the rack so the customer may browse until he or she finds the right combination. The store must carry multiple versions of the same suit for the more popular styles. The result is a high overhead in inventory for the clothing store.

A second inefficiency caused by the off-the-rack method of suit selection is a waste in cloth. A man's suit will typically be made with a pair of pants which include enough material for a reasonably long legged individual, and in addition, will include enough material so that an individual can have cuffs added to the pants if he so desires. The waste in cloth for satisfying the added length requirement when multiplied over the millions of suits produced in accordance with the off-the-rack retailing technique is tremendous.

An additional inefficiency is the trend to produce three-piece, or vested suits for a high percentage of the suits of a given size. Many individuals rarely, if ever, use the vest which accompanies the suit which in every other respect is perfect for their needs. The suit manufacturer is wasting money since in all probability the sale could have been accomplished without the vest, and of course the customer has wasted money since he has paid for the vest which he rarely uses.

A second procedure which has received much less acceptance by the suit buying public is a mail order procedure where the customer takes his own measurements and mails them to a mail order house which tailors the suit to fit those dimensions and sends back a finished suit. This mail order technique has certain rather obvious deficiencies. The person taking the measurements is not trained so the measurements he provides the suit maker may be quite different from his actual measurements. If this is the case, the only remedy is to take the poorly fitted suit to a tailor who may or may not be able to remedy the problem.

The mail order procedure is also inefficient for the suit manufacturer. The manufacturer receives the measurements from the purchaser and then must cut and sew that suit. In the off-the-rack manufacturing process, multiple numbers of identical suits can be produced. In the mail order procedure, each cut of each piece requires individual attention. While, the mail order suit purchasing procedure cuts down on inventory, the cost of manufacturing increases.

One technological advance which has received surprisingly little acceptance in the suit manufacturing industry is the use of a laser cutter to cut out the suit pieces prior to sewing them together. The Hughes Aircraft Company laser cutting apparatus, for example, has significantly increased the efficiencies with which suit parts can be cut from the original fabric. Thus far, however, the laser cutting technique has received limited acceptance perhaps because of the general tendency in the garment industry to avoid innovation and/or change.

Use of a laser cutting technique can reduce some of the manufacturing costs in producing off-the-rack suits. Whereas formerly each suit was individually cut from the fabric, the automation of the cutting process with the use of a laser allows continuous cutting of suits as well as enhances the quality with which various styles of suits can be made. The laser cutter, however, does not address the aforementioned inefficiencies with the off-the-rack suit manufacturing process. It is apparent, that if the manufacturers of custom made clothing are to effectively compete with manufacturers having a much cheaper source of labor while maintaining profit margins at an acceptable level, more automated manufacturing techniques as well as reductions in inventory costs are needed.

DISCLOSURE OF THE INVENTION

In accordance with the present invention, many of the inefficiencies noted above with respect to prior art manufacturing procedures are eliminated. Inventories and waste are reduced by use of a manufacturing process where items of apparel are made to measure for the customer. Rather than produce a high inventory of items which "approximately" fit the customer, the apparel items are cut and sewn together only after the purchaser's specifications have been analyzed and used to control the cutting of the item's constituent pieces.

In accordance with the invention custom manufacturing of an item of apparel is accomplished by first measuring a customer's body size and shape as well as analyzing the customer's style preferences. These steps will typically be performed at a retail outlet for the manufacturer. This information will be used to modify the measurements for the item and in particular will be used in generating a relative positioning of a number of pattern points for the pieces which, when assembled, make up the item.

The invention has particular applicability to the manufacture of a custom tailored suit. The pattern points define the shape of the pieces included in the suit. By knowing the relative positioning of these pattern points, the pieces can be cut from a roll of material along specified lines defined by the pattern points. A more detailed description of the concept of pattern points will be disclosed in conjunction with a referred embodiment of the invention. Once the modified position of the pattern points is known, the one or more pieces making up the garment are cut by an automated cutting machine, preferably a laser cutter, and then sewn together to produce the suit.

In accordance with a preferred embodiment of the invention, the re-positioning of the pattern points is accomplished by a programmable controller such as a computer. The computer generates control data which interfaces with a laser cutter controller so that during the cutting process the laser is cutting parts of custom made suits rather than the off-the-rack suits produced with prior art laser cutters.

There are significant advantages to the automated made-to-measure process outlined above. The retail outlets suit inventory is reduced. Various styles of suits will be included as well as various fabrics from which the customer can choose a suit, but the need for multiple suits of a given style as well as suits of every conceivable fabric are no longer necessary. Once a particular style and fabric suitable to the customer's needs is chosen, measurements are taken and used in manufacturing the suit.

As an adjunct to the reduction in inventory, waste in material and/or parts is avoided. If the customer has no desire for a vest with his suit, no vest is cut and both the customer and the manufacturer benefit.

The customer can order more than the standard number of items to the suit. An extra pair of pants with reversible vest to match that extra pair can be ordered and custom manufactured. A large variety of materials and styles is also available with no additional expenditure of retail space or inventory. This flexibility in choice, it is believd, will enhance customer satisfaction.

The disclosed invention has applicability for all shapes or sizes of people including situations where large modifications of an off-the-rack garment would be required. The measurements are taken, the pattern points generated, and the suit or other garment cut in exactly the same manner as a standard suit.

From the above, it should be appreciated that one object and advantage of the invention is a reduction in inventory and waste in the manufacture of items of apparel by implementing a made-to-measure manufacturing process utilizing an automated cutting mechanism controlled by a programmable controller. This and other advantages and features of the invention will become better understood when a detailed description of a preferred embodiment of the invention is described in conjunction with the accompanying drawings.

BRIEF DESCRIPTION OF THE DRAWINGS

FIG. 2 is a flow chart of an entire custom tailoring process of the invention.

FIG. 8 schematically illustrates a laser cutting station for cutting out garment patterns.

BEST MODE FOR CARRYING OUT THE INVENTION

Figure 1:
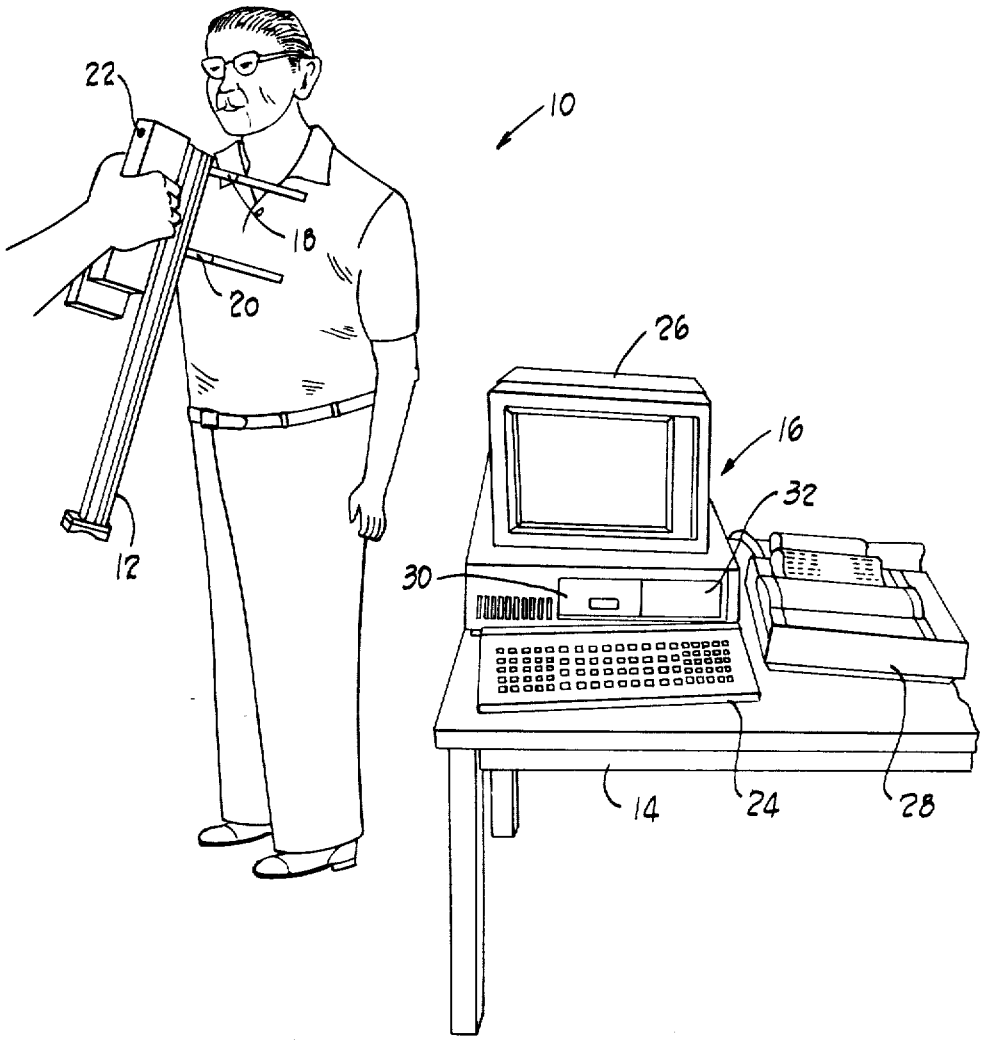
FIG. 1 is a view of a subject being measured with a hand held measuring device that communicates with a unit for storing and interpreting the subject's measurements.

Turning now to the drawings, FIG. 1 illustrates a retail setting 10 where an individual is being measured for a garment by a store clerk using a hand held measuring device 12. Supported on a table 14 is a storage unit 16 for storing measurements taken by the measuring device 12.

The hand held measuring device 12 is particularly adapted to aid one in taking measurements for use in tailoring an article of clothing or the like. The particular device 12 shown in FIG. 1 has a mechanism for taking both a length and an angle measurement.

In operation, a user positions the measuring device 12 so that two caliper arms 18, 20 are positioned to measure a desired length separation on a subject and then actuates a pushbutton switch 22 on the unit. In response to this actuation, circuitry mounted inside the device 12 generates an electrical cutput corresponding to this length and also determines an angle the device 12 makes with the vertical and generates an electrical output corresponding to this angle. These outputs are converted into signals suitable for transmission to the storage unit 16 and sequentially transmitted to that unit.

The storage unit 16 preferably comprises a personal computer having a keyboard input 24, a visual display monitor 26 and a printer 28. The storage unit 16 also includes a central processing unit mounted to a motherboard as well as interface boards for ccupling various inputs to the motherboard. One interface board provides a coupling between the central processing unit on the motherboard and a floppy disk drive 30 which comprises one suitable mechanism for storing data from the hand held measuring device 12. In accordance with a preferred embodiment of the invention the storage unit 16 comprises an IBM (registered trademark) personal computer with a hard disk drive 32 that allows rapid data storage as well as a more permanent means of storing that data.

The computer prompts the user as to the proper procedures to take in performing the various measurements the device 12 is capable of taking. Thus, the operating system of the computer sequentially prompts via the display 26 the user as to which measurement is to be taken. The user then reorients the measuring device 12 to take the particular measurement and actuates the pushbutton 22 so that a length and angle measurement are automatically transmitted to the computer 16. Additional details regarding the hand held measuring unit 12 and the storage unit 16 may be reviewed in copending U.S. patent application Ser. No. 532,245 filed Sept. 14, 1983, U.S. Pat. No. 4,586,150 entitled "Electronic Measuring Device" which is incorporated in the present application by reference.

The hand held unit 12 can be used in making a number of measurements on an individual. The unit can be suitably positioned to determine an individual's sleeve length, shoulder width, and a number of other measurements. A different hand held measuring device (not shown) described in the aforementioned and incorporated patent application includes a flexible measuring tape for measuring neck size, waist, and the like. The same storage unit 16 receives communication signals from this other hand held device.

In the following discussion regarding the automated manufacturing of a garment, the modification of so-called pattern points will be discussed in relation to a specific item making up a man's suit. This item will be the backpiece of a man's coat and in particular modifications to this backpiece as a result of variations in an individual's neck size will be discussed. It should be appreciated, however, that the modification of other pattern points in a man's suit are accomplished in a completely analogous fashion by the automated procedures to be described.

Turning now to FIG. 2, the manufacturing process will be summarized and then broken down into specific components for a more detailed discussion. In FIG. 2, the manufacturing process begins at a store location 10 (FIG. 1) where a store clerk performs 50 a series of measurements on a subject. These measurements are transmitted to the storage unit 16 which as noted above comprises a personal computer.

The storage unit performs a so-called pre-interpreter process 52 which verifies 54 a possible fit based upon the style selected. This information is combined with the customer's material selection 56 and results in the generation of an order 58 which is transmitted to a manufacturing location or factory 60. The information in the order is a combination of the customer's measurements, the order makeup (vest, pants etc.), style and the desired material for the garment, customer information such as name, address etc. and the the results generated during the pre-interpreter step 52.

At the factory a final interpreter step 62 is performed which is analogous to the pre-interpreter step and will be described in detail below. At a next step 64 alterations in a standard suit size are made based upon the output from the final interpreter step 62. Once alterations have been performed and appropriate computer control data (such as a computer tape) generated at this step 64, laser cutting of the garment is performed 66. After the garment parts have been cut and tagged, assembly takes place 68 and finally the garment is transmitted to an inventory location 70 in preparation for shipment back to the store 10 where the customer picks up the completed garment.

An important step that takes place in the store 10 is the pre-interpreter step 52. The customer's measurements and his preferences in style are analyzed to determine whether that style selection can be used in fabricating the garment. This pre-interpretation step 52 takes place at the store 10 so that an order is not generated if a fit is not possible. This avoids the situation in which an order is placed and sometime later the customer informed that this was an inappropriate choice and the garment selection process must be repeated. Immediately after the measurement step 50, the customer can be informed whether or not his style preference can be fulfilled.

A second important feature of the invention worthy of emphasis is the alteration of the patterns at the step 64. A standard garment size is used as a starting point in this step. The garment designer generates the standard size for a particular style garment and pattern points that define this style are stored on computer. These standards are then used in generating altered pattern points which define the location of various cuts to be made by the laser cutting apparatus.

If an individual came into the store 10 and his measurements indicated that a garment corresponding exactly to the designer's original design would be appropriate, no alteration in the pattern points would be necessary and therefore during the final interpreter step 62 and alteration of pattern point step 64, a factory computer would determine that no changes would be necessary and laser cutting would be performed using a setting of pattern points identical to the points resulting from the designer's original work. Typically, of course, the pattern points for any individual must be altered to some extent before laser cutting.

Many of these steps in the present invention are performed by computer, either the computer 16 at the store location, or a larger computer at the factory 60. The steps in performing the pre-interpreter 52 and final interpreter 62 process are similar.

Figure 3:
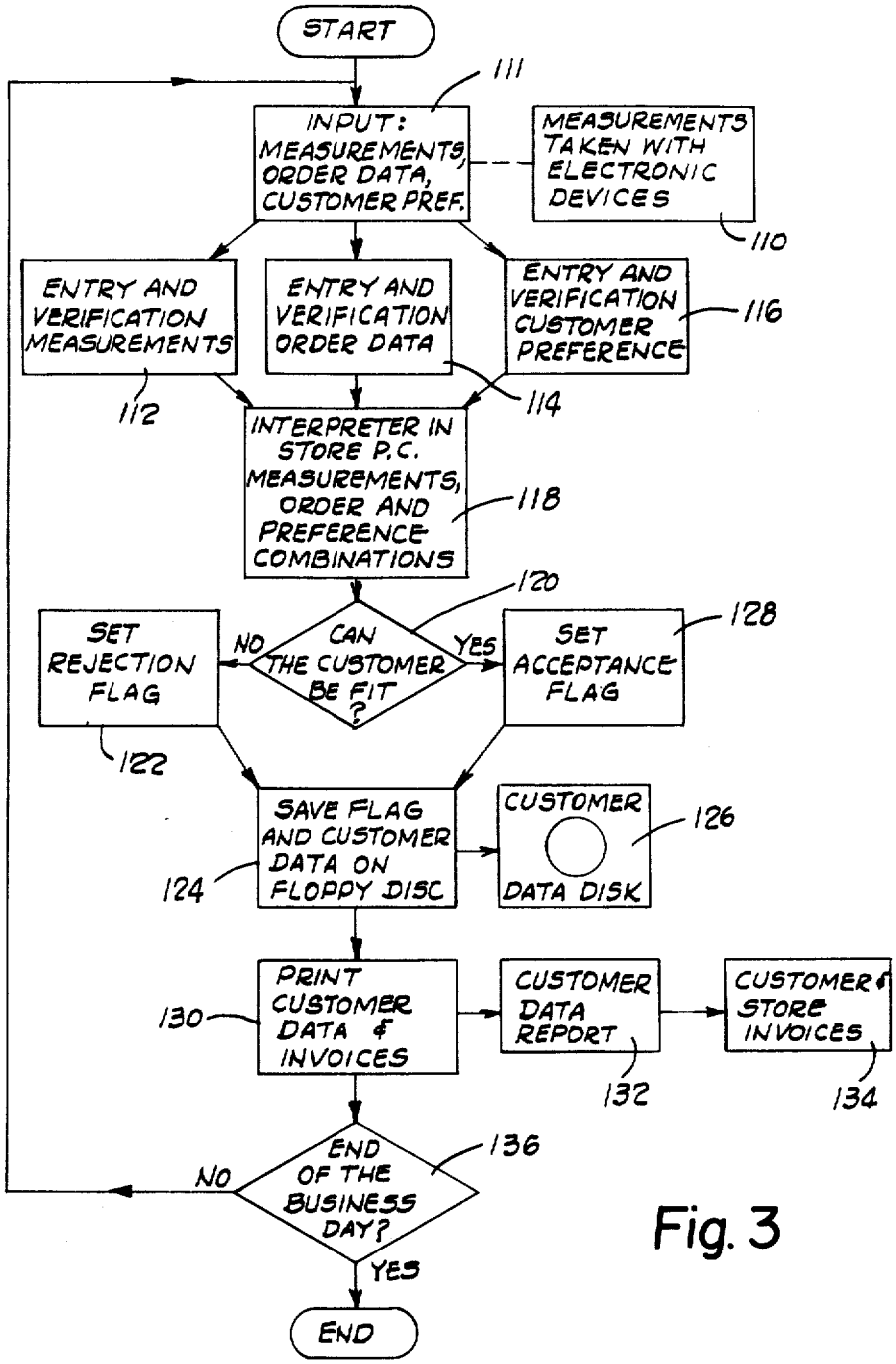
FIG. 3 is a flow chart of a portion of the FIG. 2 process that is conducted at a retail outlet.

The pre-interpreter process 52 is summarized in FIG. 3. As noted above, the pre-interpreter utilizes measurements 110 taken by the store clerk. These measurements are stored in the memory of the storage units 16. As a first step in the pre-interpretation process the measurements are combined 111 with information regarding the customer's order data and preference data. The computer then performs verification steps 112, 114, 116 to determine that the measurement information, order information and preference information is valid.

Once a determination is made that this information is valid, the in-store interpreter combines this information at a step 118 to make a determination 120 whether the customer's preferences and measurements are compatible. If the answer to this question is no, a rejection flag 122 is set and saved 124 on the floppy disk storage unit 30. A customer data disk 126 has been schematically illustrated in FIG. 3 to indicate a permanent record of this rejection is maintained at the store 10. If a fit is possible, an acceptance flag is set 128 and in a similiar fashion, this information is stored on the floppy disk 126.

The information is stored regardless of whether a fit is possible. A file is therefore created for each customer whose measurements are taken utilizing the hand held measuring device 12. This information is sent to the manufacturer and can be accessed as needed.

The rejection data can be useful in the business planning of the garment manufacturer. If enough people need a particular modification to a given style and that modification cannot be accommodated by the disclosed process, it behooves the manufacturer to create that style or allow an existing style to be modified to meet the customer's needs. Thus, if a significant percentage of customers are rejected for the same reason after selecting a particular style, modifications can be made in the style to accommodate those customers.

If an order is placed, the computer 16 next prints 130 the customer data and invoice information. This printing step involves separate generation of a customer data report 132 and generation of a customer in-store invoice 134.

This process continues until the end of the business day. If the computer decides 136 that the end of the day has not been reached, the pre-interpreter 52 returns to the start of the algorithm described in FIG. 3 and subsequent measurements for other customers are taken.

Figure 4A:
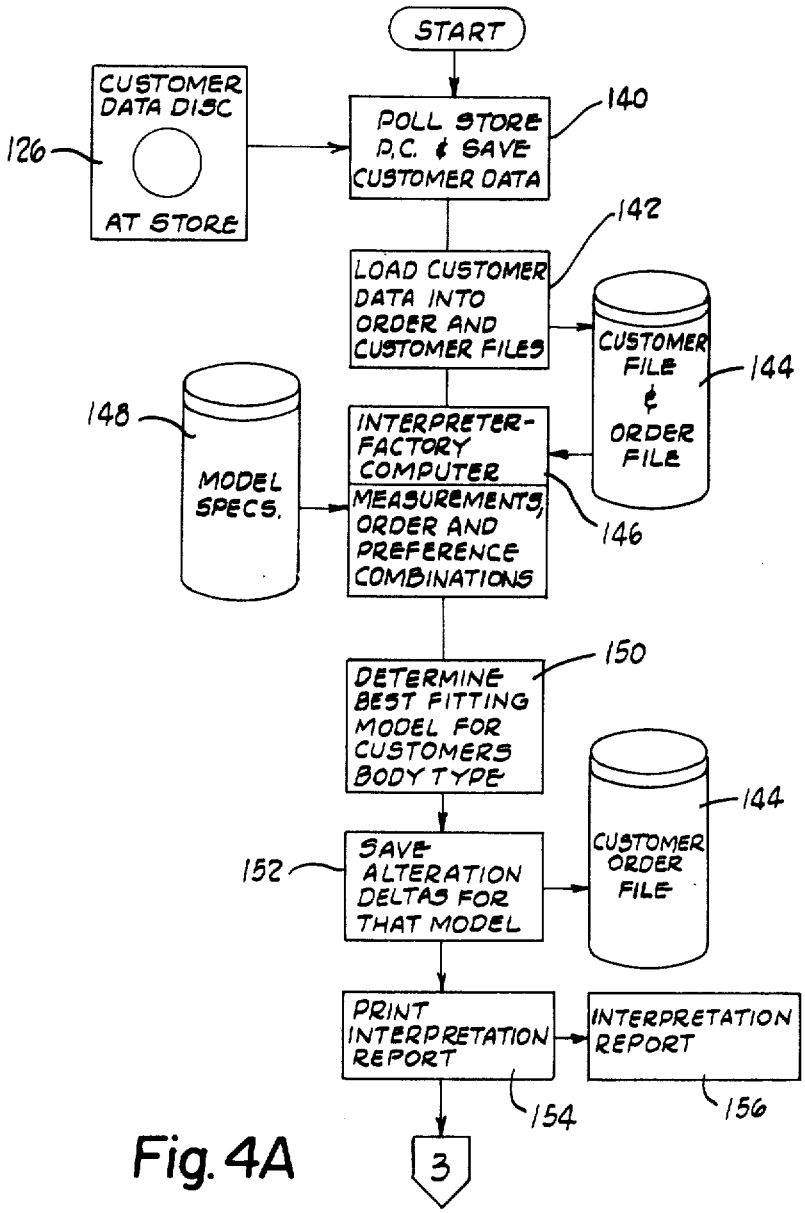
FIGS. 4A–4E define the steps of the custom tailoring operation at a factory having an automated cutting apparatus.

A communications link (not shown) between the store computer 16 and a factory computer is maintained either along a dedicated link-up or alternately over the public telephone system with the use of a modem. The factory computer is responsible for generating a control tape used by a separate factory computer 138 (FIG. 8) in controlling a laser cutter 139. The factory computer begins the process of generating a control tape by retrieving customer information at a step 140 in FIG. 4A. At this step, customer data from the floppy disk 126 at the store location is transmitted to the factory computer and this information is transmitted at a step 142 to a customer file 144 maintained on a hard disk unit forming part of the factory computer system. This information as well as being stored in non-volatile format, is loaded into the computer for utilization in a factory interpreter algorithm 146. This algorithm utilizes model specifications stored on a disk 148 to make a determination 150 regarding the best model fit for a customer's body type.

At a next step 152 in the process the computer compares the model specifications with the customer measurements to determine alterations in the model specifications to fit the particular customer. This alteration or delta information is stored on the customer order file 144. As a final step in the factory interpreter process, the computer prints 154 an interpretation report 156 for future reference.

Figure 4B:
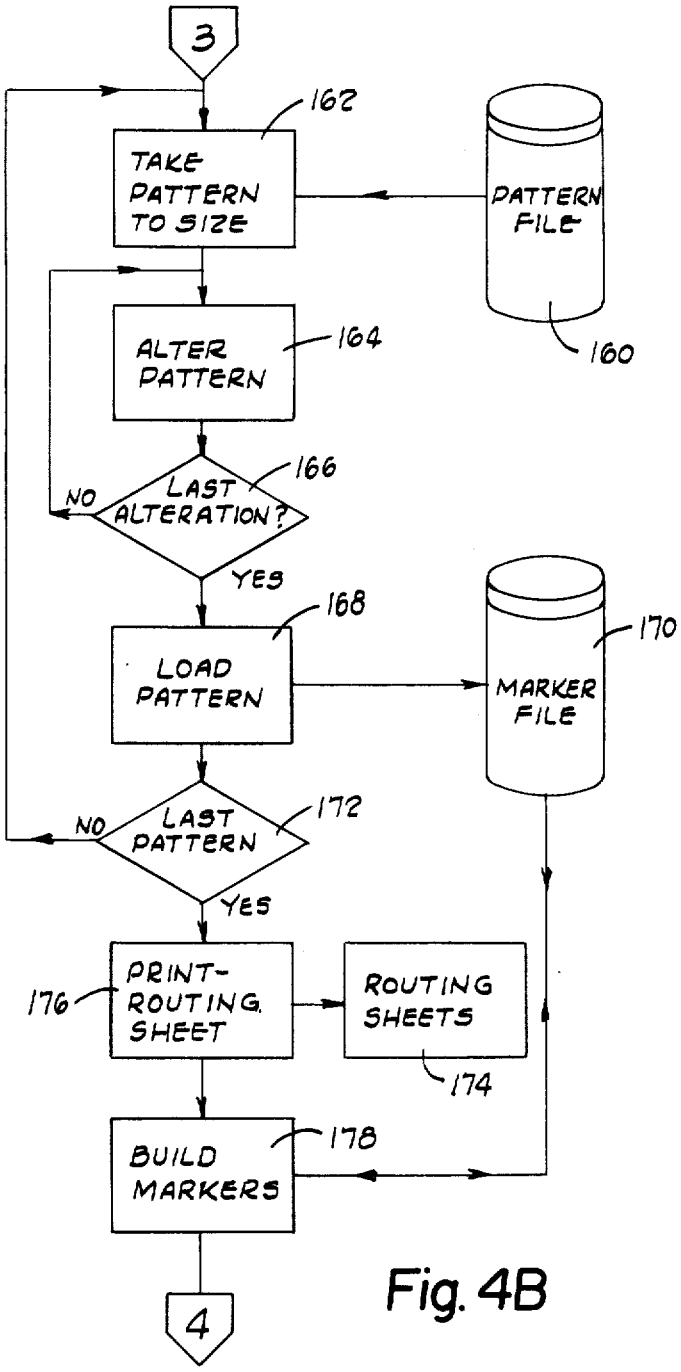

FIG. 4B schematically illustrates the steps in modifying the pattern points based upon the interpretation process 62. The pattern is altered before any laser cutting can be performed. Each garment includes a number of different patterns which are sewn together to produce that garment. The reference or pattern points are stored on a pattern file 160 which are repeatedly accessed by the computer in modifying the pattern points.

A first pattern is taken to size 162 and a number of pattern points altered 164 until a determination 166 is made all pattern points for a particular pattern have been altered. Details of this alteration process for one pattern, the back piece for a man's suit, are described below in conjunction with FIGS. 6A and 6B. Once all alterations for a particular pattern have been made, the computer loads 168 the altered pattern points for a particular pattern into a marker file 170. Once a particular pattern has been modified, a test 172 is made whether all patterns for a particular garment have been adjusted. If all garments have been adjusted, a routing sheet 174 for that garment is printed 176. If all patterns have not been modified, the computer returns to the beginning 162 to access the next set of pattern points from the pattern file 160.

Subsequent to the printing of the routing sheet 174, the modified patterns stored in the marker file 170 are utilized to layout 178 the garment on a cathode ray tube. This layout corresponds to pattern arrangement from a web of material. The process of building these markers 178 involves an operator sitting in front of a cathode ray tube and moving the patterns for a particular garment to a screen area that represents the material. As the operator arranges the patterns the arrangement is stored by the computer and used to generate a control tape for the laser cutter 139. Alternately, the process of marker generation can be accomplished automatically by a computer program.

Figure 4C:
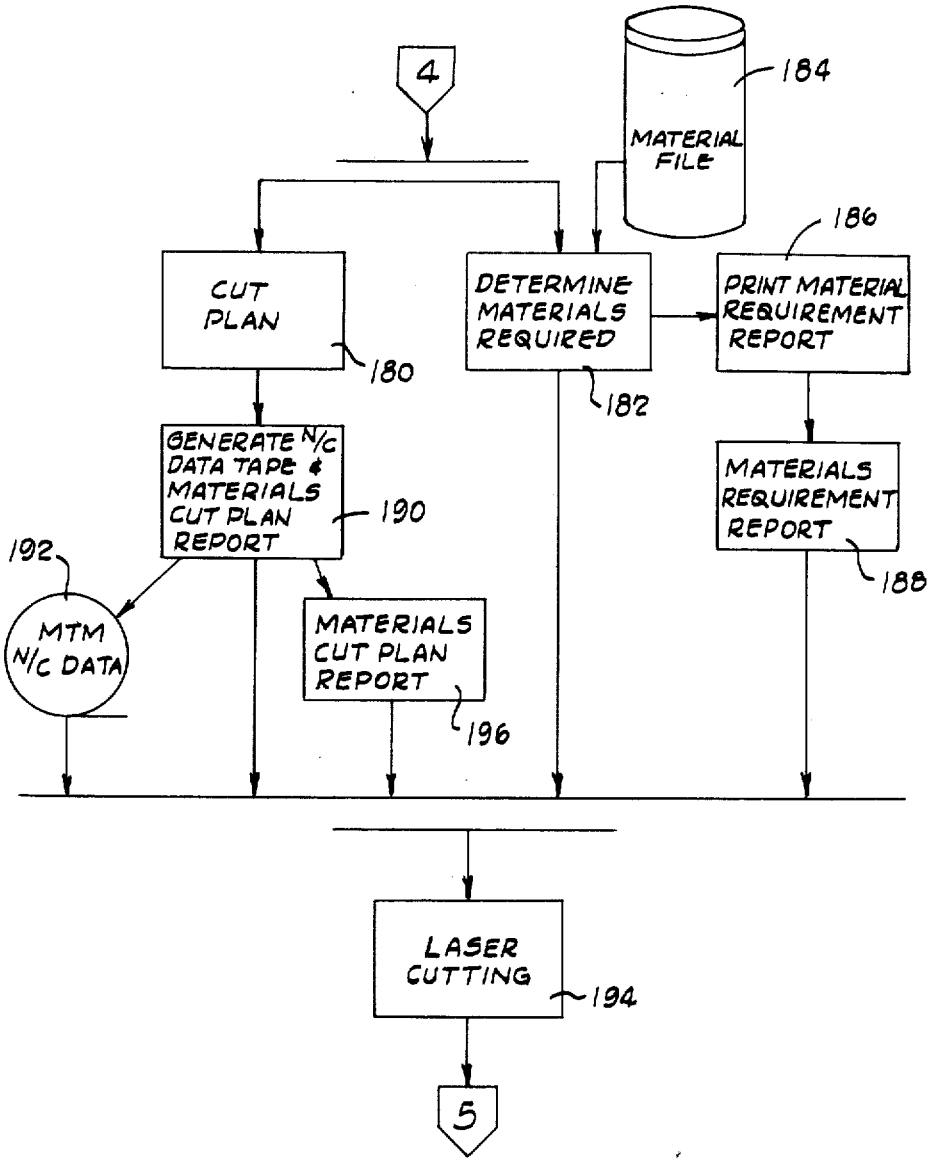

FIG. 4C summarizes bookkeeping steps that must be performed prior to laser cutting. As a number of garments are cut in sequence, a plan or order 180 of cutting must be determined. As this plan or order is being determined, a determination must also be made concerning the amount of materials required by the laser cutter. This determination 182 utilizes a material file 184 and results in the printing 186 of a material requirements report 188. Once the cut plan 180 for a number of garments has been determined, it is possible to generate 190 a control tape 192 for the computer 138 to control laser cutting of a number of garments. At the same time the control tape 192 is generated, a materials cut plan report 196 is generated indicating the sequence and timing of laser cutting.

A laser cutting station 194 is illustrated in FIG. 8. A roll 195 of fabric 197 is unwound and moved by a conveyor 198 beneath the laser cutting 139 at a controlled rate. The computer 138 responds to the control tape 192 and directs the cutter 139 to cut patterns from the fabric 197. Subsequent to laser cutting of the fabric a number of manufacturing steps (FIGS. 4D and 4E) are monitored and controlled. Prior to discussing these steps, however, details of the interpretation process 150 and pattern alteration process 164 are described.

Figure 5A:
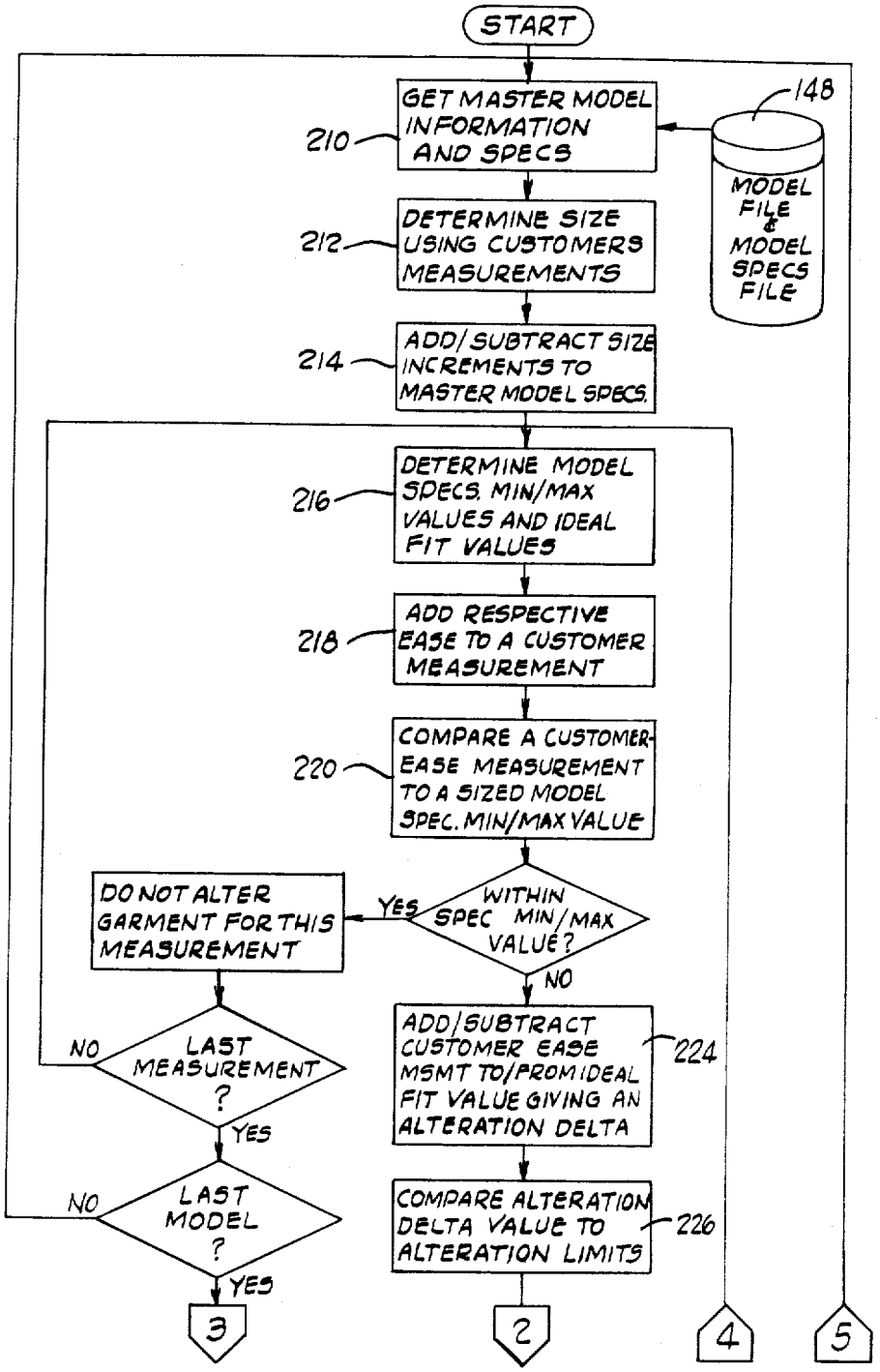
FIGS. 5A and 5B define an interpretation process for determining which model, size, and alterations of a particular style are best suited for a customer.
Figure 5B:
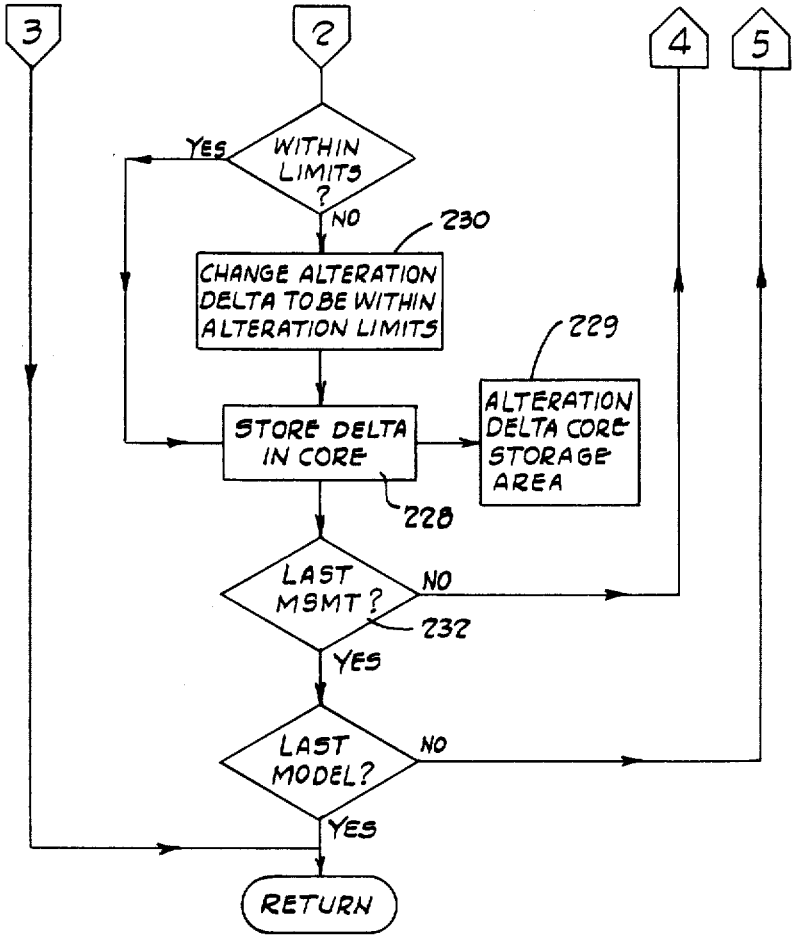

Turning now to FIGS. 5A and 5B, the details of the interpretation process 150 used to choose the best model in a subject's style choice are schematically disclosed. As a first interpreter step 210, the computer accesses model specifications stored on a disk storage 148. The interpreter determines 212 what size the customer needs based upon the measurements and adds or subtracts 214 increments to the master model specifications stored on disk 148. This addition or subtraction is required for a suit, for example, if the customer measurements call for anything other than a size 40 regular. At a next step 216, minimum and maximum values are determined for each of the measurements for the particular size the customer needs. Also at this step an ideal value for each measurement is determined.

At a next step 218, a customer ease is added to a particular customer measurement. This ease factor is the amount a customer measurement must be incremented to give the ideal garment measurement. At a next step the customer ease measurement is compared 220 to the model minimum and maximum values. If the customer measurement including ease is within the minimum or maximum value, the garment need not be altered based upon this measurement. Each measurement in turn is compared in this way until all measurements have been compared with the minimum and maximum values.

If a particular measurement is not within the minimum and maximum values, an alteration delta is generated 224 and this delta factor is compared 226 with alteration limits. If this change or delta is within limits, this alteration delta is stored 228 in memory 229. If it is not within limits, the alteration change is modified 230 to be within the alteration limits and then stored 228. Eventually, either each measurement will have been seen to be within the minimum and maximum value and therefore no change in that measurement is needed or an alteration delta will be generated for that particular measurement.

Once it is determined 232 that all measurements have been analyzed, specifications for a different model are accessed 210 by the interpreter and the same process performed for each of the measurements for that particular model. In a preferred embodiment, four different models are analyzed for each style. One of these models produces the best fit for that customer's measurements. The model that produces that best fit is used to manufacture the garment. The customer knows that the suit corresponds to a particular style but does not know which model among the four possible choices for a particular style the computer will choose in matching his or her style preferences with his or her unique measurements. The optimum model choice depends on how many measurements are beyond the minimum/maximum values as well as the size of the alteration deltas generated for each of the multiple models.

Figure 6A:
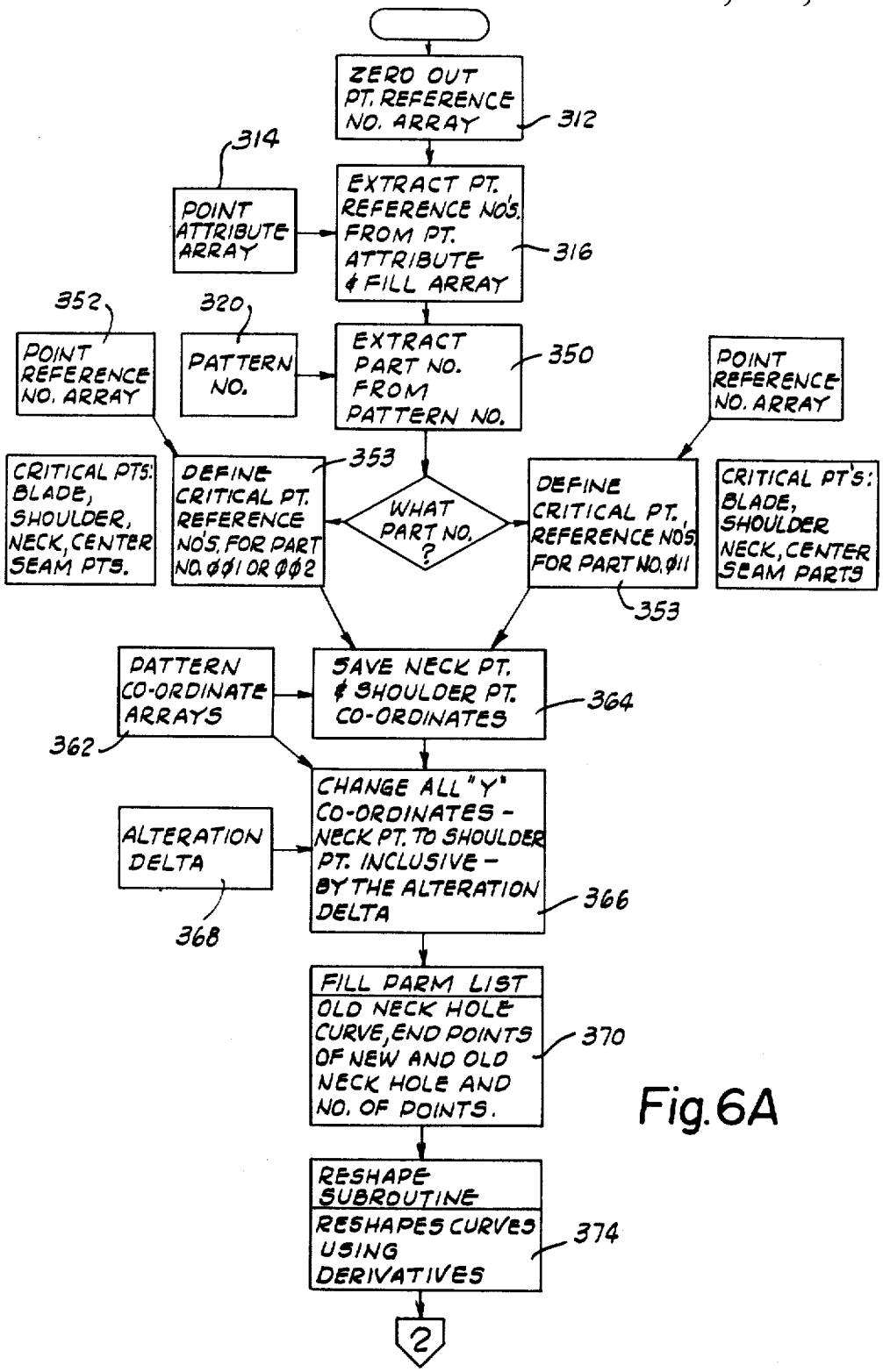
FIGS. 6A and 6B illustrate an example of the modification of pattern points of a garment.
Figure 6B:
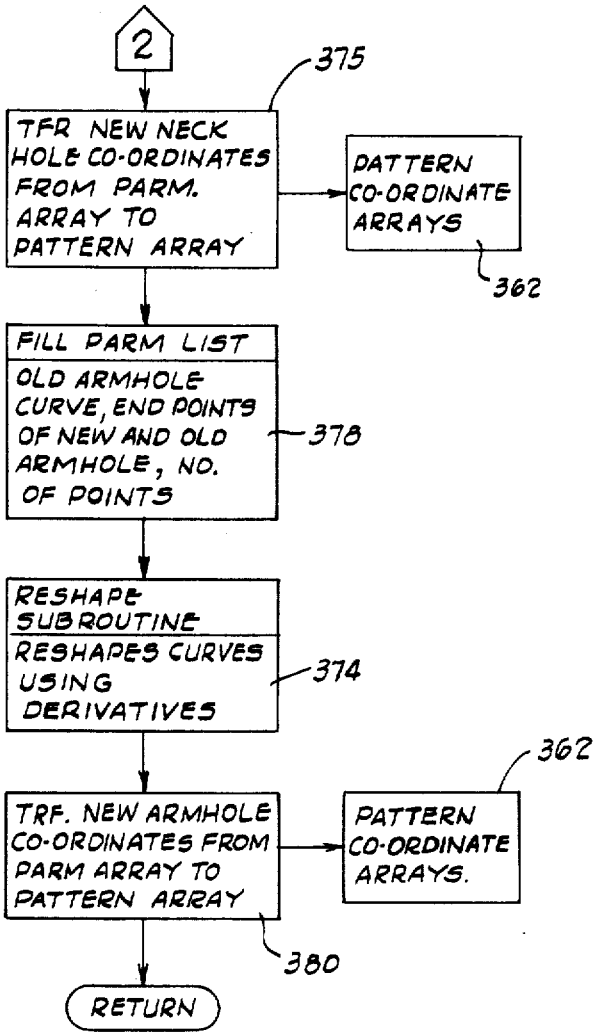
Figure 7:
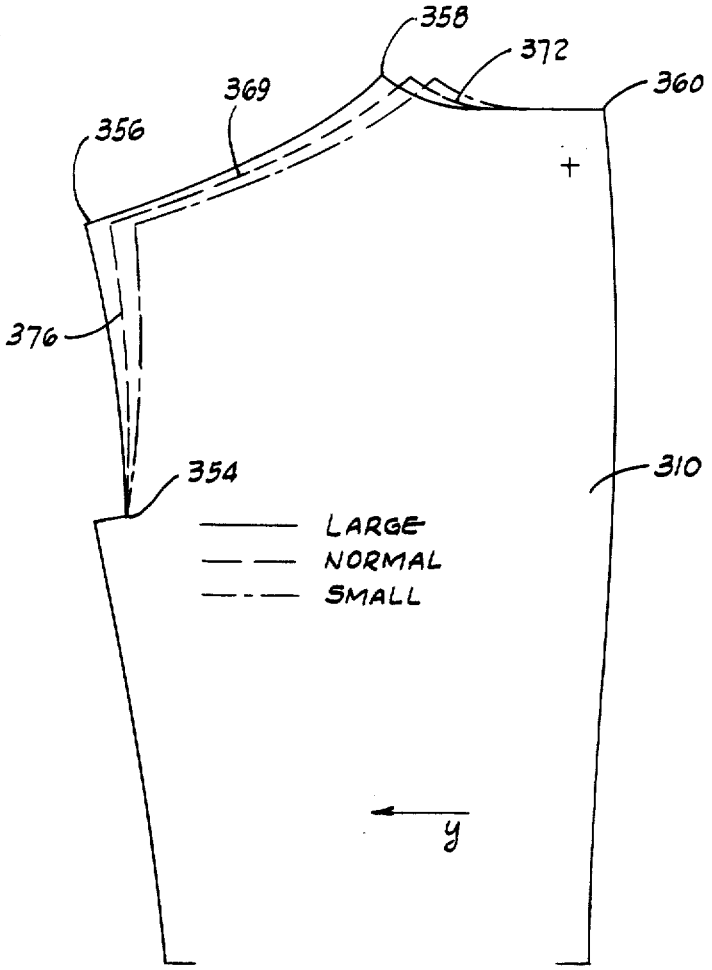
FIG. 7 shows three different garment patterns with pattern points modified for different customer measurements.

Turning now to FIGS. 6A, 6B and 7 the modification or alteration 164 of the reference points for a particular pattern will be discussed in conjunction with a specific example. This process takes place after a particular garment model has been choosen. The specific example discussed is the modification of the back pattern 310 (FIG. 7) for a man's suit based upon variations from a normal neck dimension.

At the beginning of the FIG. 6A procedure a point reference array 352 is initialized 312. Each of approximately seventy points that define the back pattern 310 has an entry in a point attribute array 314 which tells what position in the point reference array that point occupies. This position is extracted 316 so that the point reference array is filled with the reference numbers of each of the seventy points.

Each pattern has a ten digit pattern number 320 with the last three digits corresponding to a part number. To be more specific, in the back pattern number the part number can refer to either the cloth back (pattern 011) or one of two (patterns 001, 002) linings for the back. Based upon this part number, certain critical points of the pattern are defined and extracted 353 from the point reference array 352.

Returning to the backpiece example, the critical points for both the cloth back and lining are the blade 354, shoulder 356, neck 358, and center seam 360 points (FIG. 7). A pattern co-ordinate array 362 stores the X and Y co-ordinates for each of the points which define a particular pattern and size. Stated another way, the backpiece for a 44 normal (for example) has 70 pattern points to define the backpiece of FIG. 7. TAhe X-Y co-ordinates for these 70 points is stored in the pattern co-ordinate array.

The FIG. 6A algorithm saves 364 the neck and shoulder point co-ordinates by ascertaining the position of these points from the point reference array 352 and then changes 366 the Y co-ordinate (see FIG. 7) of each of the pattern points between the neck point and the shoulder point inclusive by an alteration or delta factor 368 based upon the subject's neck dimension. This results in a shift to the right (small neck) or left (large neck) of the curve 369 between the shoulder 356 and neck point 358. These altered point co-ordinates are saved in the pattern co-ordinate array 362.

A parameter array is then filled 370 from the co-ordinants of the points defining the old neck hole curve 372 and the new and old end points 358, 360 for the neck hole curve. A reshaping subroutine 374 reshapes the neck hole 372 and fills in co-ordinates for the new pattern into the parameter array. This reshaping is based upon an approximation method using derivatives (slopes) of the old curve and the new or altered endpoints. As a next step the parameter array co-ordinates are transferred 375 back to the pattern array 362 and define the altered pattern.

At a next step the co-ordinates for the original armhole curve 376, and the end points 354, 356 for the new and old armhole curve are entered 378 into the parameter array and the reshaping subroutine 374 modifies the co-ordinate points along the armhole 376. Finally the new armhole co-ordinates are transferred 380 from the parameter array to the pattern array 362. A modification in the back based upon neck size is complete and the computer goes on to make modifications based upon other measurements for other patterns until the pattern points for the entire garment have been altered. This data is all stored and is represented by the patterns presented to the CRT operator who builds 178 the material cut arrangements. The altered patterns then, of course, become embodied in the computer control tape 192.

Figure 4D:
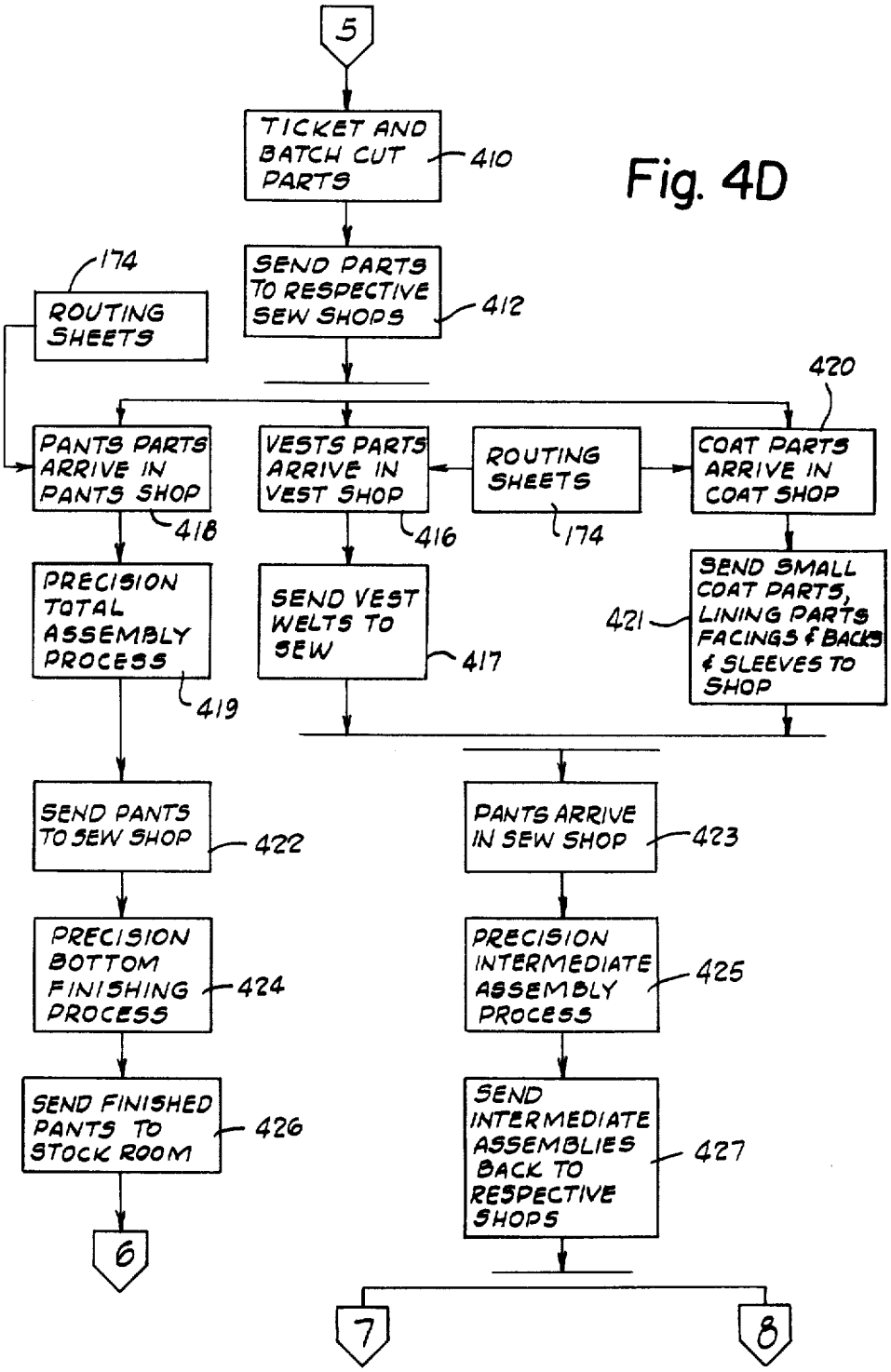
Figure 4E:
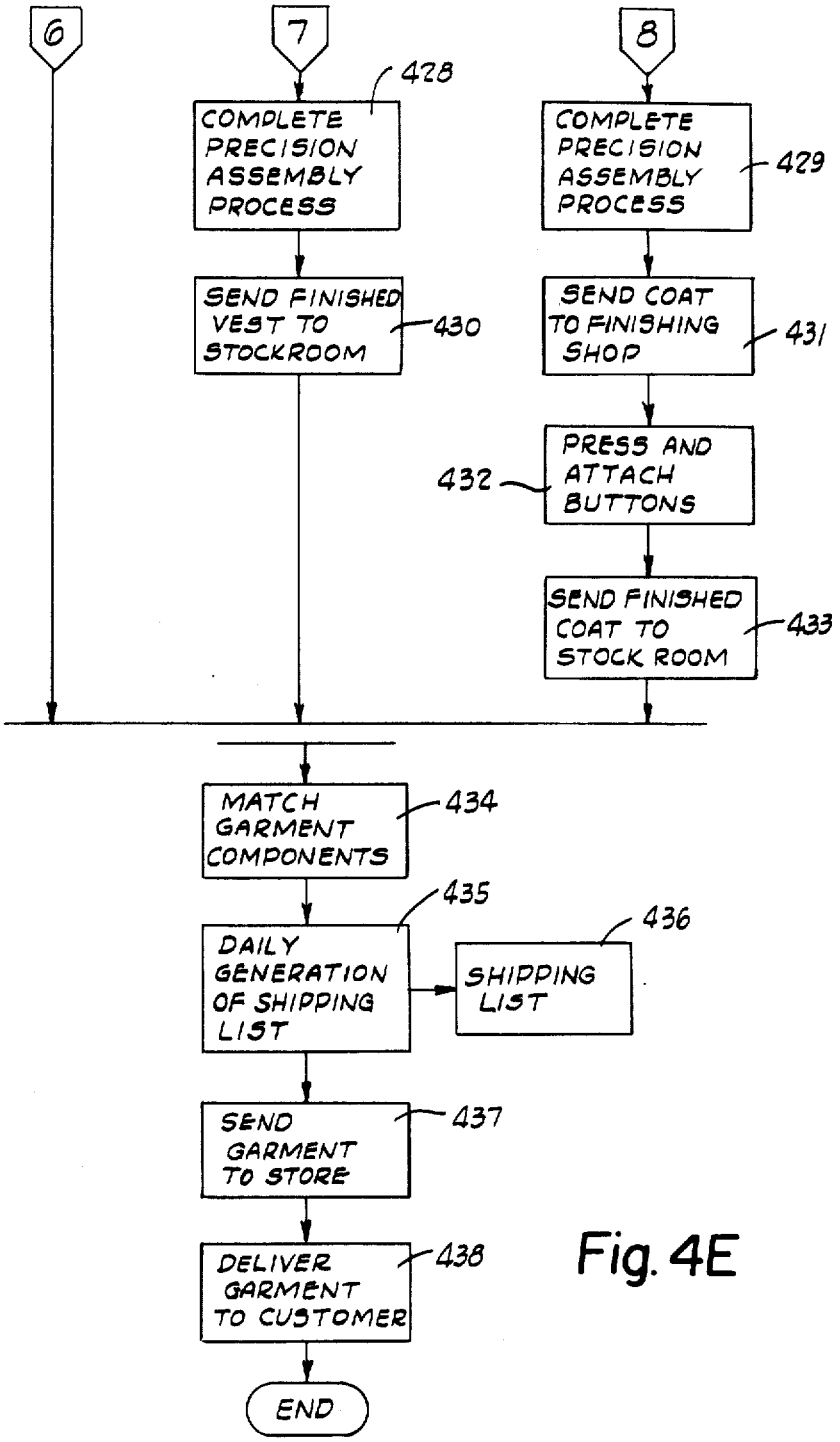

FIGS. 4D and 4E schematically illustrates post-laser cutting procedures utilized in the automated garment manufacturing process. At this stage of fabrication, a number of garment pieces have been cut using the laser cutter and these pieces are ticketed or marked 410 and sent 412 to appropriate locations for sewing. Routing sheets 174 are generated to indicate the particular path a garment pattern must follow.

The routing sheets 174 contain control data used in the manufacture of the garment. This control data is used to insure the proper and precise assembly of the garment since each garment is unique and requires different handling during assembly.

The control data is any information needed for the precise assembly of a garment. This data can be anything as specific as the proper positioning of a pocket or button to something as general as whether or not to edge stitch the lapel or a specific way the finished garment needs to be pressed.

The control data also includes finished dimensions of the garment. These dimensions are used for quality control during the various phases of the manufacturing process. This control data can be in either a printed form for manual assembly or in a numeric control form for automated assembly.

After the routing sheets are generated the remaining steps 416–438 in FIGS. 4D and 4E are performed. Briefly, each of the parts or patterns goes to its respective sewing shops where parts are sewn together and sent to a stockroom (FIG. 4E) where all the garment components (jacket, pants, vest, etc) are matched 434 together. The garment is then shipped 437 back to the store and delivered 438 to the customer.

It should be noted by referring to the steps 424, 428, 429 where garment patterns are sewn together, the term precision is used. This term is required in the fabrication process since it would be counter productive for the precision alteration of the various pattern points to be performed under computer control, first in the generation of the control tape and secondly in the laser cutting and then lose this precision by sloppy sewing at the sew shops. If the suit or other garment is made to fit the customer with the aid of the computer, the sewing steps 424, 428, 429 must be precisely carried out with the highest standards of quality control maintained.

The generation 435 of a daily shipping list is in conformity with the automated steps described above. When the subject's measurements are taken, that subject is promised a suit on a given delivery day which is co-ordinated with the back log of orders at the factory.

The shipping list generated at the stage 435 after the garment components have been assembled in the stockroom, is based upon that earlier order information and unless production has fallen behind for a legitimate reason the two dates should match.

The disclosed invention has been described with a degree of particularity. The choice of computer system and measuring devices for both retail and factory locations is based upon the memory and storage requirements of the manufacturing system. As business needs dictate, this computer system choice can be modified. The manufacturing process need not be limited to a men's suit although certain ones of the manufacturing steps have obviously been described in relation to a man's suit. It is the intent therefore that all alterations and/or modifications falling within the spirit or scope of the appended claims be protected.

We claim:

1. A method for custom manufacturing an item of apparel comprising the steps of:

performing a set of measurements to obtain a subject's body size and shape;

modifying said measurements to obtain a set of modified measurements related to an item size that take into account the subject's size and shape;

comparing said modified measurements with a range of values for each measurement to determine an optimum model of the item of apparel most suitable for the subject;

examining each of one or more pieces which in combination make up said optimum model to determine which of the modified measurements require alterations of a standard pattern of said one or more pieces;

using results of said examining step to relocate the relative position of a number of previously positioned pattern points for a standard grade of the one or more pieces of said item of apparel; and cutting said one or more pieces of said item from a source of material by moving an automated cutting machine along controlled paths defined by the relative positioning of said relocated pattern points.

2. The method of claim 1 wherein said cutting machine is a computer controlled laser, and said material comprises segments of a fabric stitched together wherein each segment has dimensions sufficient to provide pieces for at least one item of apparel.

3. The method of claim 1 wherein said automated cutting machine includes a computer controlled laser and wherein said manufacturing method further comprises the step of generating a control program of said computer based upon the relative position of the pattern points.

4. The method of claim 1 wherein the pattern point positions derived from the modified measurements are based upon a first set of pattern points corresponding to the pattern points for a particular style and size item of apparel.

5. A method for custom manufacturing a garment comprising the steps of:

determining a position for each of a number of pattern points on each piece of said garment to define a standard garment;

assessing a subject by measuring the subject's size and determining the subject's body type and style preferences;

modifying the positions of said pattern points as a function of the size, body type and style preference of the subject who is to wear said garment, said modifying step performed by the substeps of identifying critical pattern points for each piece of said garment, correlating these critical pattern points to one or more specific subject measurements, moving, if necessary, the critical points a distance dictated by the one or more specific subject measurements, and repositioning other pattern points based on movement of the critical pattern points; and cutting each piece by moving an automated cutter in relation to a piece of material from which said garment is to be made, said moving controlled by a programmable controller programmed to move said cutter along a path related to said modified position of said pattern points.

6. The method of claim 5 which additionally comprises the step of generating manufacturing control data for said garment indicating post-cutting procedures to be performed in bringing said pieces together in a specific manner to form said garment.

7. Apparatus for computerized manufacturing of garments from a number of individual garment pieces comprising:

means for storing a standard relative positioning between pattern points on each piece of said garment;

means for modifying the standard relative positioning of said pattern points for each garment piece based upon the size of a person who is to wear said garment; said means for modifying including means for determining which critical pattern points to move based upon the size of the person and for re-adjusting the standard positioning of pattern points affected by movement of the critial pattern points;

means for controlling a sequence of movements of a laser cutter used to cut out said pieces from a layer of material; and means for generating an input to said means for controlling based upon said modified relative position of said pattern points.

8. The apparatus of claim 7 wherein said means for controlling comprises a computer which receives said input in the form of a numerical data.

9. Apparatus for automated fabrication of an article of apparel comprising:

a first computer for storing a standard positioning between a number of pattern points for one or more pieces of said article;

said first computer having means for modifying the relative positioning of a subset of the number of standard pattern points in response to an input to said computer, said input related to a modification in the size of said one or more pieces;

means for calculating modified positions for others of said standard pattern points based upon the modified position of the subset of standard pattern points;

means for moving a material along a flat surface on which it can be cut;

an automated cutter for cutting said material on said flat surface;

means for controllably moving said cutter in relation to said material on said surface along paths dictated by said modified position of the pattern points, said means for moving including a second computer specifically dedicated to controlling a cutter movement; and means for generating an input to said second computer, said means for generating communicating with said first computer to utilize the modified pattern point positions in generating said input.

10. The apparatus of claim 9 wherein said cutter comprises a laser cutter.

11. The apparatus of claim 10 wherein said input comprises data from the first computer in a format suitable able for receipt by said second computer for controlling movement of said laser cutter.

12. A method for fabricating an article of manufacture comprising the steps of:

determining a standard position for each of a number of pattern points on a pattern for a standard article of manufacture;

planning a modified article of manufacture by adjusting one or more dimensions of the standard;

modifying the positions of only those points whose relative position is changed by adjusting the dimensions of said article; and cutting said article by moving a laser cutter in relation to a piece of material from which said article is to be made, said moving controlled by a programmable controller programmed to move said laser cutter along a path related to said modified position of said pattern points.

13. The method of claim 12 wherein said determining and modifying steps are performed for a number of like articles and said cutting step is performed for a number of said articles from one portion of material.

14. Apparatus for computerized fabrication of an article of manufacture comprising:

means for storing a relative position between pattern points on a standard of said article;

means for modifying the relative position of certain ones but not all of said pattern points based upon one or more altered dimensions of said article to be fabricated;

means for relatively positioning those pattern points of the article affected by the movement of said certain ones of said pattern points;

means for controlling a sequence of movements of an automated cutter used to cut out said article from a layer of material; and means for generating an input to said means for controlling based upon said modified pattern points.

15. The apparatus of claim 14 wherein said means for controlling comprises a computer which receives said input in the form of a numerical data and said automated cutter comprises a laser cutter.

16. A method for automated pattern grading and manufacture of an item of apparel comprising the steps of:

measuring a subject and recording specified measurements;

determining if said specified measurements require alterations of pattern points that define the standard graded item of apparel;

if the specified measurements do require an alteration, calculating modified positions for one or more pattern points whose relative position are affected by the alteration;

storing both modified and unmodified pattern point positions to define a custom item of apparel; and directing an automated fabric cutter to cut at least one layer of fabric along a path defined by the modified and unmodified pattern point positions.

17. The method of claim 16 where the item of apparel comprises a plurality of pieces which are sewn together to complete the article, said process further comprises the step of determining which pieces need alterations.

18. The method of claim 17 additionally comprising the step of using the stored modified and unmodified pattern points to generate a control program for automated cutting of a fabric to create the pieces prior to sewing.

19. The method of claim 18 which additionally comprises the steps of generating manufacturing control data for said garment to indicate post-cutting procedure to be performed in preparation for sewing the pieces together.

20. Apparatus for custom pattern grading and manufacture of an item of apparel comprising:

means for storing specified measurements of a subject who is to wear the item of apparel;

means for determining if said specified measurements require alterations of pattern points that define a standard graded item of apparel;

means for calculating modified positions for one or more pattern points if the relative position of the one or more points are affected by the specified measurements;

means for storing both modified and unmodified pattern point positions to define the custom graded item of apparel; and means to automatically cut at least one layer of fabric along a path defined by the modified and unmodified pattern point positions.

21. The apparatus of claim 20 where the item of apparel comprises a plurality of pieces which are sewn together to complete the article and said means for determining determines which pieces need alterations.

* * * * *